US008115371B2

(12) United States Patent
Kyuno et al.

(10) Patent No.: US 8,115,371 B2
(45) Date of Patent: Feb. 14, 2012

(54) SPARK PLUG

(75) Inventors: Jiro Kyuno, Kiyosu (JP); Akira Suzuki, Nagoya (JP); Kenji Ban, Gifu (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 12/744,783

(22) PCT Filed: Nov. 25, 2008

(86) PCT No.: PCT/JP2008/071761

§ 371 (c)(1),
(2), (4) Date: May 26, 2010

(87) PCT Pub. No.: WO2009/069796

PCT Pub. Date: Jun. 4, 2009

(65) Prior Publication Data

US 2010/0314987 A1 Dec. 16, 2010

(30) Foreign Application Priority Data

Nov. 26, 2007 (JP) ..... 2007-304358

(51) Int. Cl.
*H01T 13/20* (2006.01)

(52) U.S. Cl. ..... 313/141; 313/143

(58) Field of Classification Search ..... None
See application file for complete search history.

(56) References Cited

U.S. PATENT DOCUMENTS

| | | | | |
|---|---|---|---|---|
| 5,877,584 | A | 3/1999 | Kato et al. | |
| 5,929,556 | A | 7/1999 | Matsubara et al. | |
| 5,977,695 | A * | 11/1999 | Osamura et al. | 313/141 |
| 7,408,294 | B2 | 8/2008 | Okabe et al. | |
| 2003/0085643 | A1 | 5/2003 | Matsubara | |
| 2005/0057131 | A1 | 3/2005 | Kanao et al. | |
| 2005/0168120 | A1 | 8/2005 | Kanao | |
| 2006/0028108 | A1 * | 2/2006 | Okabe et al. | 313/143 |

FOREIGN PATENT DOCUMENTS

| | | | |
|---|---|---|---|
| JP | 4262388 | A | 9/1992 |
| JP | 09-199260 | A | 7/1997 |
| JP | 10-041047 | A | 2/1998 |
| JP | 2000-243535 | A | 9/2000 |
| JP | 2001-237045 | A | 8/2001 |
| JP | 2005-116513 | A | 4/2005 |
| JP | 2005-243610 | A | 9/2005 |
| JP | 2006-049207 | A | 2/2006 |

* cited by examiner

*Primary Examiner* — Ashok Patel
(74) *Attorney, Agent, or Firm* — Sughrue Mion, PLLC

(57) ABSTRACT

A spark plug having a front end of an insulating member which projects 2 mm or more from a front end face of a metal shell and a volume of the insulating member which lies within a range from a front end of the insulating member to a position lying 1 mm towards a rear end side is 11 $mm^3$ or smaller. When the positions PA, PB, PC and PD are as defined herein, a parallel displacement amount E by which the straight line BC is displaced parallel until it contacts PD is 0.75 mm or larger. In this manner, the occurrence of lateral spark and inside spark can be suppressed effectively.

11 Claims, 15 Drawing Sheets

*FIG. 6*

| SAMPLE NO. | FRONT END HOLE DIAMETER OF METAL SHELL D1 | FRONT END DIAMETER OF INSULATING MEMBER D2 | CLEARANCE C | GAP G | C/G |
|---|---|---|---|---|---|
| No.1 | 6 | 5.2 | 0.40 | 1.1 | 0.36 |
| No.2 | 6 | 5.2 | 0.40 | 0.8 | 0.50 |
| No.3 | 6 | 5.2 | 0.40 | 0.6 | 0.67 |
| No.4 | 6 | 4.8 | 0.60 | 1.1 | 0.55 |
| No.5 | 6 | 4.8 | 0.60 | 0.8 | 0.75 |
| No.6 | 6 | 4.8 | 0.60 | 0.6 | 1.00 |
| No.7 | 6 | 4.6 | 0.70 | 1.1 | 0.64 |
| No.8 | 6 | 4.6 | 0.70 | 0.8 | 0.88 |
| No.9 | 6 | 4.6 | 0.70 | 0.6 | 1.17 |
| No.10 | 6 | 4.4 | 0.80 | 1.1 | 0.73 |
| No.11 | 6 | 4.4 | 0.80 | 0.8 | 1.00 |
| No.12 | 6 | 4.4 | 0.80 | 0.6 | 1.33 |
| No.13 | 6 | 4.2 | 0.90 | 1 | 0.90 |
| No.14 | 6 | 4.2 | 0.90 | 0.8 | 1.13 |
| No.15 | 6 | 4.2 | 0.90 | 0.6 | 1.50 |
| No.16 | 6 | 4 | 1.00 | 1.1 | 0.91 |
| No.17 | 6 | 4 | 1.00 | 0.8 | 1.25 |
| No.18 | 6 | 4 | 1.00 | 0.6 | 1.67 |
| No.19 | 6 | 3.8 | 1.10 | 1.1 | 1.00 |
| No.20 | 6 | 3.8 | 1.10 | 0.8 | 1.38 |
| No.21 | 6 | 3.8 | 1.10 | 0.6 | 1.83 |
| No.22 | 6 | 3.3 | 1.35 | 1.1 | 1.23 |
| No.23 | 6 | 3.3 | 1.35 | 0.8 | 1.69 |
| No.24 | 6 | 3.3 | 1.35 | 0.6 | 2.25 |

SPARK PLUG

TECHNICAL FIELD

The present invention relates to a spark plug built in an internal combustion engine for igniting a fuel mixture.

BACKGROUND ART

Conventionally, in an internal combustion engine, spark plugs are used to ignite fuel mixtures. As is shown in FIG. 21, a general spark plug includes a center electrode, an insulating member which holds the center electrode in an axial hole, a metal shell which surrounds the periphery of the insulating member to hold the insulating member, and a ground electrode which is joined to the metal shell at a proximal end portion and which forms a spark gap at a distal end portion with the center electrode. The fuel mixture is ignited by a spark discharge occurring in the spark gap. Although the form of the spark plug shown in FIG. 21 is of a so-called projecting type, in addition to this, there are spark plugs of a slant type and a semi-creeping type (refer to JP-A-6-176849).

In recent years, valve diameters of intake valves and exhaust valves are required to be extended to increase the output of an internal combustion engine. A larger water jacket is also required to be equipped on such an internal combustion engine whose output is increased in that way in order to cool the engine with good efficiency. However, with these required countermeasures implemented, since a space where to install spark plugs, which are to be install in the internal combustion engine, becomes small, spark plugs with smaller diameters are now required.

However, in the event that the diameter of a spark plug is reduced simply, an insulating distance between an insulating member and a metal shell is narrowed. Because of this, depending upon how carbon deposits are accumulated on the insulating member, a lateral spark in which a spark occurs from the center electrode to the metal shell via an insulator or an inside spark in which a spark occurs from the center electrode to the metal shell through a gap between the insulator and the metal shell is generated (refer to FIG. 21). When lateral sparks and inside sparks occur frequently, the frequency of discharge at the normal spark gap decreases, thus, there is a problem of ignition with fuel mixture.

In relation to these problems, for example, JP-A-2006-49207 discloses a spark plug for suppression of the lateral spark in which an outside diameter of a front end of an insulating member is formed so as to be increased gradually from a front end side to a rear end side and a volume from the front end of the insulating member to a position lying 0.1 mm rearwards from the front end is 0.38 $mm^3$ or lower. JP-A-2000-243535 discloses a spark plug including a center electrode having a high melting point metal tip, wherein a thickness of a portion of an insulating member which is positioned to face a front end face of a metal shell is 1.1 mm or larger and further, an outside diameter of a portion of the center electrode which is positioned to face a front end of the insulating member is 1.4 mm or larger and 2.0 mm or smaller.

DISCLOSURE OF THE INVENTION

A problem that the invention is to solve in view of the problems described above is how to provide a spark plug which can suppress effectively a lateral spark and an inside spark even with a small diameter configuration from a different viewpoint from that of the related art.

In order to solve at least a part of the problems described above, a spark plug of one aspect of the invention is configured as follows. That is, the spark plug comprises: a rod-shaped center electrode; a substantially cylindrical insulating member which has an axial hole extending along a direction of an axis of the center electrode and holds the center electrode within the axial hole while allowing a front end portion of the center electrode to be exposed; a substantially cylindrical metal shell which is provided on an outer circumference of the insulating member; and a ground electrode which is joined to a front end face of the metal shell and which forms a spark gap with a front end portion of the center electrode, wherein a front end portion of the insulating member projects 2 mm or larger from the front end face of the metal shell, and a volume of a portion of the insulating member which lies within a range from a front end to a position lying 1 mm towards a rear end of the insulating member from the front end is 11 $mm^3$ or smaller, and wherein when assuming in a section of the spark plug which passes through the axis that: a corner portion where a front end face of the insulating member and a side surface of the axial hole intersect is referred to as a position PA, a position on the center electrode where a straight-line distance from the position PA to the center electrode within the axial hole becomes shortest is referred to as a position PB, a position where the insulating element first contacts the metal shell from the front end face of the insulating member along a surface of the insulating member is referred to as a position PC, and a position on the insulating member where when a straight line BC which connects the position PB with the position PC is displaced parallel towards an outside of the axis, the straight line BC contacts the surface of the insulating member is referred to as a position PD, a parallel displacement amount E by which the straight line BC is displaced parallel so as to contact the position PD is 0.75 mm or more.

In the spark plug formed as described above, the front end portion of the insulating member projects 2 mm or larger from the front end face of the metal shell, and the volume of the portion of the insulating member which lies within the range from the front end to the position lying 1 mm towards the rear end from the front end of the insulating member is specified as being 11 $mm^3$ or smaller. According to the spark plug formed in this way, since the temperature of the front end of the insulating member can be increased quickly, carbons, which constitutes a cause for a lateral spark, can burned off quickly. As a result of this, even with a spark plug with a smaller diameter than the standard one, the generation of a lateral spark can be suppressed effectively. Further, in the spark plug formed as described above, by the parallel displacement amount E being referred to as 0.75 mm or larger, an outer circumferential projecting amount of the spark plug can be ensured. As a result of this, the generation of an inside spark from the center electrode to the gap between the insulating member and the metal shell can be suppressed. Although the position PC is the position where the insulating member first contacts the metal shell from the front end face of the insulating member along the surface of the insulating member, the concept of the metal shell is understood to include metallic members such as a packing which communicates electrically with the metal shell. The reference characters PA, PB, PC, PD and the like are only given as a matter of convenience to distinguish the positions to which the reference characters are so given from other positions, and hence, the positions can be expressed in another way.

In the spark plug of the above aspect, a small diameter portion where a diameter of the front end portion of the center electrode is reduced may be formed at the front end portion of the center electrode, and the diameter R1 of the front end portion of the center electrode and the diameter R2 of the small diameter portion may have the following relationship, $0.75 \leqq R2/R1 \leqq 0.95$. Further, in the spark plug of the above aspect, a depth of a gap defined between the small diameter portion and the insulating member from the front end face of the insulating member may be 0.5 mm or larger and 2.0 mm or smaller.

According to the spark plug formed in this way, since the temperature at the front end portion of the insulating member can be increased quickly, the lateral spark can be suppressed effectively.

In the spark plug of the above aspect, the front end portion of the insulating member and the front end portion of the metal shell may be disposed to provide a predetermined gap in a position corresponding to the front end face of the metal shell, and a dimension of the gap may be 0.8 to 1.3 times a dimension of a spark gap defined between the ground electrode and the center electrode.

According to this form, since the gap between the insulating member and the metal shell and the dimension of the spark gap can be set to an optimal ratio, even with the spark plug with the small diameter, an igniting performance equal to or better than that of a spark plug with the standard diameter can be ensured. Further, according to the ratio, even in the event that the diameter of the spark plug is reduced, the thicknesses of the metal shell and the ground electrode do not have to be thinned more than required. Because of this, even in the event that the diameter of the spark plug is decreased, the strength thereof can be ensured.

In the spark plug of the above aspect, a dimension of the spark gap may be 0.6 mm or larger and 1.2 mm or smaller. According to this form, a sufficient gap can be ensured between the front end portion of the insulating member and the front end portion of the metal shell while ensuring the ignition performance.

In the spark plug of the above aspect, a thickness of a portion of the insulating member which lies in a position situated 1 mm towards the rear end from the front end of the insulating member may be 0.7 mm or larger. According to this form, an inside spark, which tends to take place with no carbon deposit, can be suppressed effectively.

In the spark plug of the above aspect, an outside diameter of the center electrode in a position corresponding to the front end face of the metal shell may be 1.2 mm or larger and 2.1 mm or smaller. According to the center electrode formed in that way, the realization of a spark plug having a smaller diameter than the standard one can be facilitated.

In the spark plug of the above aspect, a noble metal tip may be provided on at least either of the front end portion of the center electrode and a distal end portion of the ground electrode. According to the form, the ignition performance of the spark plug can be improved.

In the spark plug of the above aspect, the front end portion of the center electrode and the distal end portion of the ground electrode may face each other on the axis of the center electrode. Further, in the spark plug of the above aspect, the front end portion of the center electrode and the distal end portion of the ground electrode may face each other outside the axis of the center electrode.

In the spark plug formed as described above, the metal shell may include a mounting portion having threads provided for tightening the spark plug to an internal combustion engine in part of the metal shell, a thread portion of the mounting portion being M10 or M12. According to this form, a spark plug whose diameter is smaller than that of a spark plug with a standard size M14 can be provided by selecting from existing specified sizes.

BRIEF DESCRIPTION OF THE DRAWINGS

FIG. 6 is a table showing dimensions of samples prepared in a second example.

BEST MODE FOR CARRYING OUT THE INVENTION

Hereinafter, an embodiment of a spark plug, which is a mode of the invention, will be described by reference to the drawings. The embodiment of the spark plug will be described in the following order.

A. Construction of Spark Plug:

B. Respective Dimensions of Portions:

C. Examples:

D. Modified Examples:

A. CONSTRUCTION OF SPARK PLUG

Figure 1:
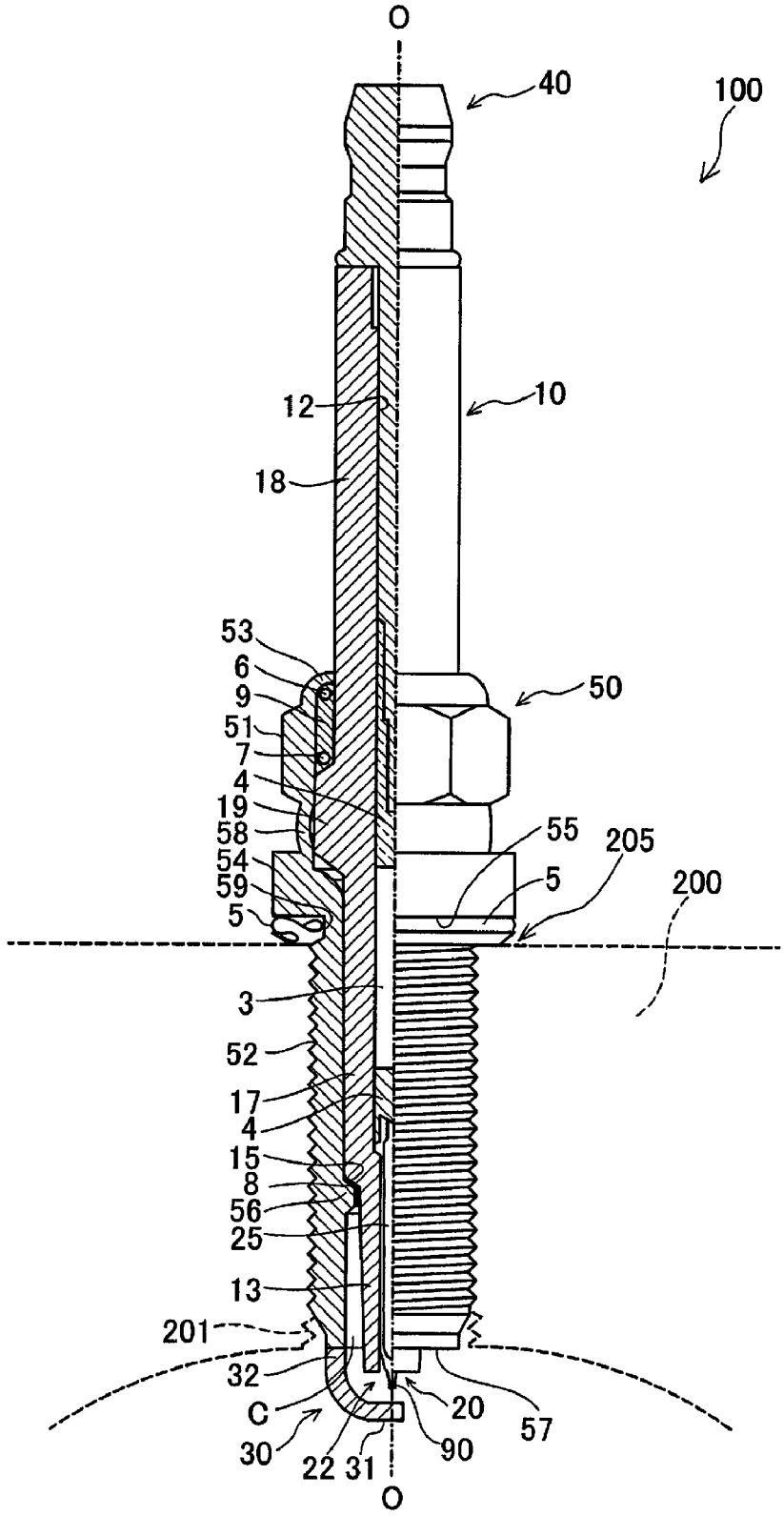
FIG. 1 is a partial sectional view of a spark plug 100.
Figure 2:
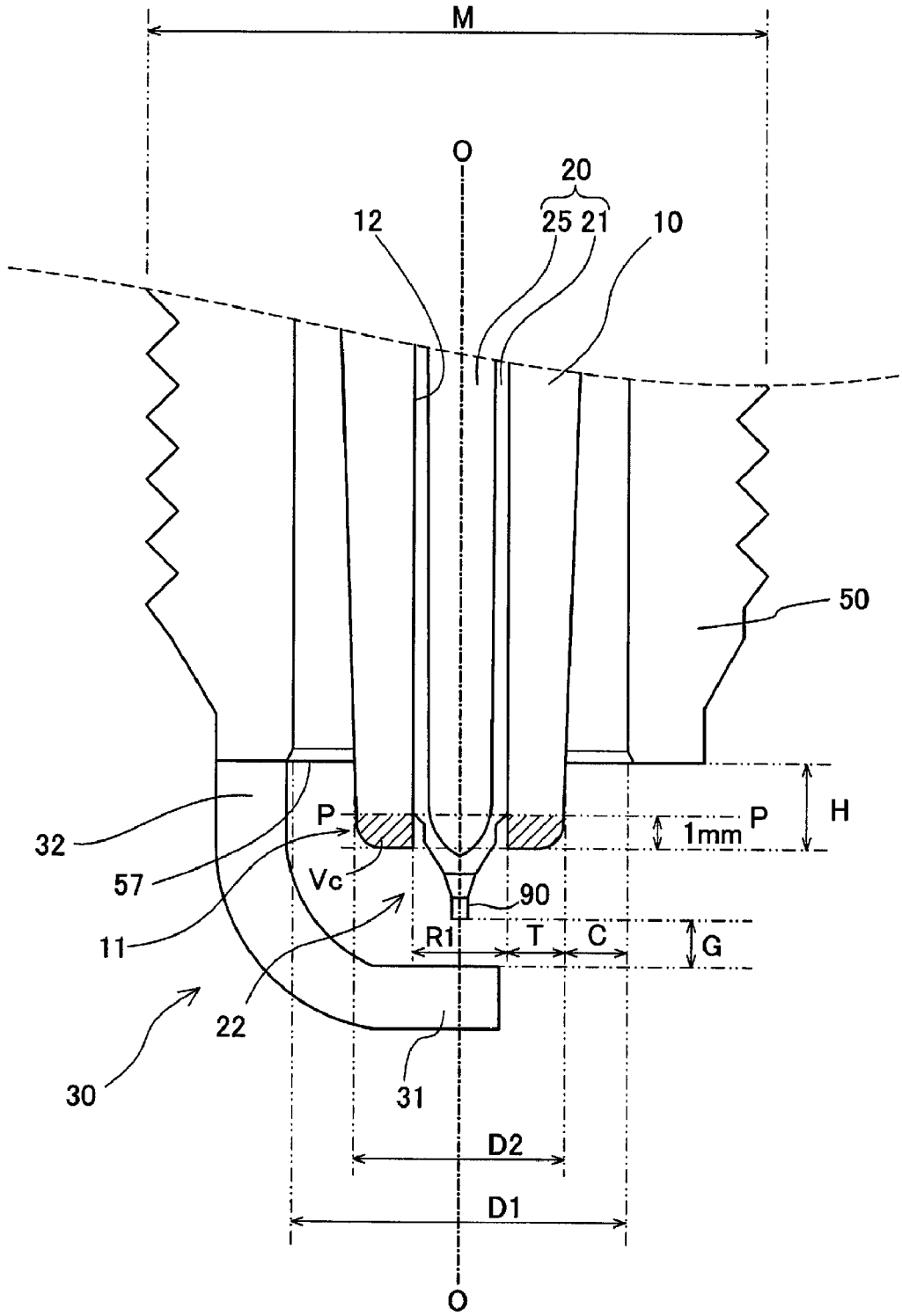
FIG. 2 is an enlarged view of the vicinity of a front end portion 22 of a center electrode 20.

FIG. 1 is a partial sectional view of a spark plug 100, and FIG. 2 is an enlarged view of the vicinity of a front end portion 22 of a center electrode 20 of the spark plug 100. In FIG. 1, the description will be made with a direction of an axis O of the spark plug 100 referred to as a vertical direction, a lower side of the figure referred to as a front end side of the spark plug 100 and an upper side of the figure referred to as a rear end side thereof.

As is shown in FIG. 1, the spark plug 100 includes an insulator 10 as an insulating member, a metal shell 50 which holds the insulator 10, a center electrode 20 which is held within the insulator 10 in a direction of an axis O of the spark plug 100, a ground electrode 30 which is welded to a front end face 57 of the metal shell 50 at a base portion 32 thereof and which faces a front end portion 22 of the center electrode 20 on one side surface of a distal end portion 31 thereof, and a terminal metal fitting 40 which is provided at a rear end portion of the insulator 10.

As is known, the insulator 10 is formed by calcining alumina or the like and has a cylindrical shape in which an axial hole 12 is formed in a center of thereof so as to extend in the direction of the axis O. A flange portion 19 having a largest outside diameter is formed substantially at a center of the insulator 10 in the direction of the axis O, and a rear end side body portion 18 is formed to extend rearwards from the flange portion 19 towards a rear end side (an upper side in FIG. 1). A front end side body portion 17, whose outside diameter is smaller than that of the rear end side body portion 18, is formed to extend forwards from the flange portion 19 towards a front end side (a lower side in FIG. 1), and a long leg portion 13, whose outside diameter is smaller than that of the front end side body portion 17, is formed to extend forwards from the front end side body portion 17. The long leg portion 13 is reduced in diameter as it extends towards the front end side so as to be exposed in a combustion chamber when the spark plug 100 is mounted in a cylinder head 200 of an engine. A riser portion 15 is formed between the long leg portion 13 and the front end side body portion 17.

As is shown in FIG. 2, the center electrode 20 is a rod-shaped electrode and has a construction in which a core material 25, which is made of copper or an alloy which contains as a primary ingredient copper having better heat transfer properties than those of an electrode base material 21 which is formed of a nickel such as Inconel (trade name) 600 or 601 or an alloy which contains nickel as a primary ingredient, is embedded in an interior of the electrode base material 21. Normally, a center electrode 20 is prepared by filling a core material 25 in an interior of an electrode base material 21 which is formed into a bottomed cylindrical shape and stretching the electrode base material 21 by extruding it from a bottom side. Although the core material 25 has a constant outside diameter in a body portion, the core material 25 is formed into a tapered shape on a front end side thereof.

The front end portion 22 of the center electrode 20 projects further forwards than a front end portion 11 of the insulator 10 and is formed so as to be reduced in diameter as it extends towards a front end side thereof. With a view to improving the spark wear resistance thereof, an electrode tip 90 made of a noble metal having a high melting point is joined to a front end face of the front end portion 22 of the center electrode 20. The electrode tip 90 can be formed of, for example, iridium (Ir) or an Ir alloy which contains Ir as a primary ingredient and one or two or more of platinum (Pt), rhodium (Rh), ruthenium (Ru), palladium (Pd) and rhenium (Re).

The joining of the center electrode 20 and the electrode tip 90 is implemented by laser welding which goes round a full outer circumference of mating surfaces of the electrode tip 90 and the center electrode 20 while being aimed at the mating surfaces. In the laser welding, since both the materials are melted to be mixed together by being irradiated by laser, the electrode tip 90 and the center electrode 20 are joined together strongly. The center electrode 20 is extended towards the rear end side within the axial hole 12 and is electrically connected to the terminal metal fitting 40 at the rear (upper in FIG. 1) by way of a seal member 4 and a ceramic resistance 3 (refer to FIG. 1). A high-tension cable (not shown) is connected to the terminal metal fitting 40 via a plug cap (not shown) so that a high voltage is applied to the terminal metal fitting 40.

The ground electrode 30 is made of a metal having high corrosion resistance, and as an example, a nickel alloy such as Inconel (trade name) 600 or 601 is used. This ground electrode 30 has a substantially rectangular cross-sectional shape when taken along a plane at right angles to a longitudinal direction thereof, and the base portion 32 is joined to the front end face 57 of the metal shell 50 by welding. The distal end portion 31 of the ground electrode 30 is bent so as to face the front end portion 22 of the center electrode 20 on the one side thereof on the axis O.

The metal shell 50 is a cylindrical metallic shell which fixes the spark plug 100 in the cylinder head 200 of the internal combustion engine. The metal shell 50 holds the insulator 10 in an interior thereof so as to surround a portion of the insulator 10 which extends from part of the rear end side body portion 18 to the long leg portion 13. The metal shell 50 is formed of a low carbon steel material and includes a tool engagement portion 51 with which a spark plug wrench, not shown, is brought into engagement and a mounting screw portion 52 where screw threads are formed which screw into a tapped mounting hole 201 in the cylinder head 200 provided in an upper portion of the internal combustion engine.

A flange-like seal portion 54 is formed between the tool engagement portion 51 and the mounting screw portion 52. A ring-like gasket 5, which is formed by bending a plate member, is fittingly inserted into a screw neck 59 between the mounting screw portion and the seal portion 54. The gasket 5 is pressed and collapsed to be deformed between a seating surface of the seal portion 54 and an opening circumferential portion 205 of the tapped mounting hole 201. A gap between the spark plug 100 and the cylinder head 200 is sealed by the deformation of the gasket 5, whereby the interruption of gastightness within the engine via the tapped mounting hole 201 is prevented.

A thin crimping portion 53 is provided further rearwards towards the rear end than the tool engagement portion 51 of the metal shell 50. A thin buckling portion 58, which is as thin as the crimping portion 53, is provided between the seal portion 54 and the tool engagement portion 51. Annular ring members 6, 7 are interposed between an inner circumferential surface of a portion of the metal shell 50 which extends from the tool engagement portion 51 to the crimping portion 53 and an outer circumferential surface of the rear end side body portion 18 of the insulator 10, and powder of talc 9 is filled between both the ring members 6, 7. The insulator 10 is pressed towards the front end side within the metal shell 50 via the ring members 6, 7 and the talc 9 by crimping the crimping portion 53 while bending it inwards. By this, the riser portion 15 of the insulator 10 is supported on a riser portion 56 formed in a position where the mounting screw portion 52 resides on an inner circumference of the metal shell 50 via a ring-like plate packing 8 made of iron, whereby the metal shell 50 and the insulator 10 are made integral. As this occurs, gastightness between the metal shell 50 and the insulator 10 is held by the plate packing 8, whereby combustion gases are prevented from flowing out. Since the buckling portion 58 is designed to be deflected and deformed outwards as a compression force is applied thereto when the crimping occurs, a compression stroke of the talc 9 in the direction of the axis O is increased. As a result of this, the gastightness within the metal shell 50 is increased. A clearance C of a predetermined dimension is provided between the metal shell 50 and the insulator 10 in an area situated further forwards towards the front end side than the riser portion 56.

B. RESPECTIVE DIMENSIONS OF PORTIONS

Next, referring to FIGS. 2 to 4, respective dimensions of portions of the spark plug 100 will be described. As is shown in FIG. 2, in the spark plug 100 of this embodiment, an outside diameter M (a nominal diameter) of the mounting screw portion 52 is referred to as M10 which is smaller than M14 which is a standard outside diameter. An outside diameter R1 of a portion of the center electrode 20 which lies in the vicinity of the front end face 57 of the metal shell 50 is referred to as 1.2 mm or larger and 2.1 mm or smaller. In this embodiment, although the outside diameter M of the mounting screw portion 52 is described as being referred to as M10, the outside diameter M may be referred to as M12.

In this embodiment, a projecting amount H (mm) of the insulator 10 by which it projects from the front end face 57 of the metal shell 50 towards the front end side in the direction of the axis O is specified to 2 mm or larger. The reason that the projecting amount is specified to that dimension will be described in a first example, which will be described later.

In this embodiment, a volume Vc ($mm^3$) of a hatched portion of the insulator 10 shown in FIG. 2 is specified to 11 $mm^3$ or smaller. The volume Vc of the hatched portion in FIG. 2 represents a volume of a front end side portion of the insulator 10 when the center electrode 20 is cut at a plane P (whose section is indicated by a chain double-dashed line P-P) which passes through a position which is situated 1 mm away towards the rear end side from a front end of the insulator 10 in the direction of the axis O and intersects the axis O at right angles. The reason that the volume Vc is referred to as 11 $mm^3$ or smaller will be described in a second example, which will be described later.

In this embodiment, the clearance C defined between the front end portion of the metal shell 50 and the front end portion of the insulator 10 is specified so as to satisfy the following relation (1) with a spark gap G (mm) in the position corresponding to the front end face 57 of the metal shell 50. Note that the spark gap G is a distance between the distal end portion 31 of the ground electrode 30 and the electrode tip 90 which is provided at the front end of the center electrode 20. The reason that the relation (1) is established will be described in the second example, which will be described later.

$$0.8 \leqq (C/G) \leqq 1.3 \quad (1)$$

In this embodiment, the spark gap G is referred to as 0.6 mm or larger and 1.2 mm or smaller. Because of this, it is inevitable that the clearance C becomes a dimension of 0.48 mm or larger and 1.56 mm or smaller based on the relation (1) above in accordance with the dimension of the spark gap G.

In this embodiment, a thickness T of a portion of the insulator 10 which lies in the position corresponding to the front end face 57 of the metal shell 50 is specified to 0.7 mm or larger. The reason that the thickness is specified to that dimension will be described in a third example, which will be described later.

Figure 3:
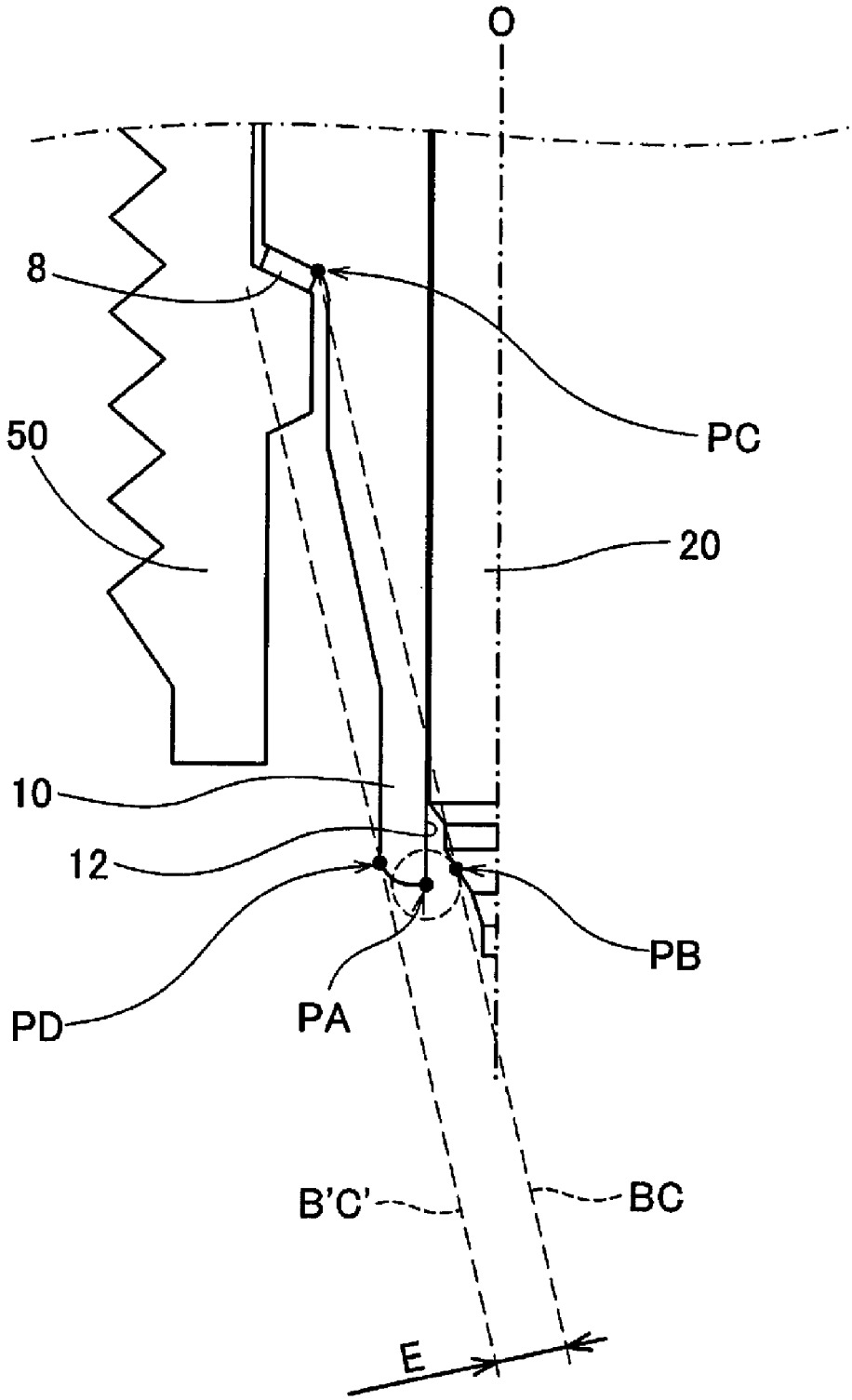
FIG. 3 is a view showing respective dimensions of portions in the vicinity of the front end portion 22 of the center electrode 20.

In this embodiment, as is shown in FIG. 3, the positions PA to PD in the section which passes through the axis O of the spark plug 100 are defined as below, and a projecting amount E which is calculated based on these positions is referred to as 0.75 mm or larger. The reason for this dimension will be described in a fourth example, which will be described later. The projecting amount E is a dimension which represents an extent by which the insulator 10 projects outwards of the axis O.

Position PA: A corner portion where a front end face of the insulator intersects a side surface of the axial hole 12.

Position PB: A position on the center electrode 20 where a straight line from the position PA to the center electrode 20 within the axial hole 12 becomes shortest. In other words, the PB is the position of a contact point between the center electrode 20 and an imaginary circle contacts the center electrode 20 when the imaginary circle is drawn from the position PA.

Position PC: A position where the insulator 10 first contacts the metal member (the metal shell 50 or the plate packing 8 which electrically communicates with the metal shell 50) in an area extending from the front end face of the insulator 10 along a surface of the insulator 10.

Position PD: A position on the insulator 10 where when a straight line BC which connects the position PB with the position PC is displaced parallel towards an outside of the axis O, this straight line BC tangentially contacts the surface of the insulator 10. In other words, in FIG. 3, the position PD is the position of a contact point between a straight line B'C' which results when the straight line BC is displaced parallel and the surface of the insulator 10.

Projecting Amount E: A parallel displacement amount by which the straight line BC is displaced parallel so as to contacts the position PD.

Figure 4:
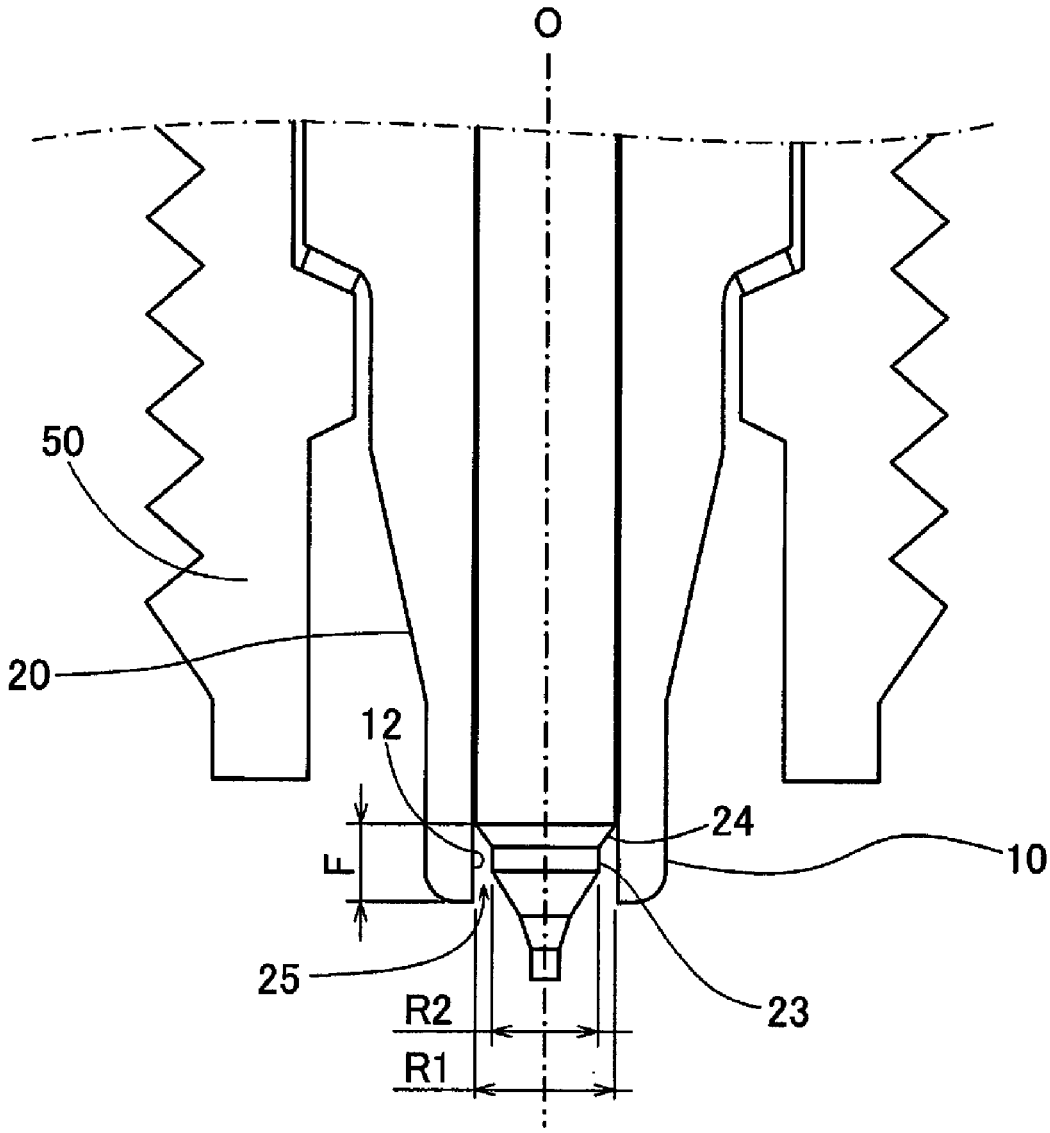
FIG. 4 is a view showing respective dimensions of portions in the vicinity of the front end portion 22 of the center electrode 20.

In this embodiment, as is shown in FIG. 4, a diameter R1 of a portion of the front end portion 22 of the center electrode 20 where the axial hole 12 contacts the center electrode 20 and a diameter R2 of a small diameter portion 23 where the diameter of the front end portion 22 of the center electrode 20 is relatively reduced by one size via a tapered portion 24 are specified so as to satisfy the following relation (2). The reason that this relation (2) is established will be described in a fifth example, which will be described later.

$$0.75 \leqq R2/R1 \leqq 0.95 \quad (1)$$

In this embodiment, a depth F of a gap (hereinafter, referred to as a "pocket portion 26") defined between the small diameter portion 23 and the axial hole 12 in the insulator 10 which is measured from the front end face of the insulator 10 is referred to as 0.5 mm or larger and 2.0 mm or smaller. The reason for this range will be described in a sixth example, which will be described later.

Thus, as has been described heretofore, in the spark plug 100 which has the relatively small diameter as is represented by its outside diameter of M10, the occurrence of lateral spark and inside spark can be suppressed effectively by controlling the respective dimensions of the portions of the spark plug 100 of the embodiment.

The spark plug 100 can be fabricated by the following fabricating method, for example. Namely, it is a fabricating method comprising the steps of preparing a center electrode 20, an insulator 10, a metal shell 50 and a ground electrode 30 which adopt the constructions and dimensions that have been described above, assembling the insulator 10 so as to cover an outer circumference of the center electrode 20 with a front end portion of the center electrode 20 exposed, assembling the metal shell 50 on to an outer circumference of the insulator 10 so that a front end portion of the insulator 10 projects 2 mm or larger from a front end face of the metal shell, and joining a base portion of the ground electrode 30 to the front end face of the metal shell 50 with a distal end portion of the ground electrode 30 caused to face the front end portion of the center electrode 20.

C. EXAMPLES

Hereinafter, the reasons that the respective dimensions of the individual portions are specified as described above will described based on various examples.

C-1 First Example

In a first example, the reason that the projecting amount H is referred to as 2 mm or larger will be described. Firstly, in this first example, a plurality of samples of spark plugs 100 were prepared which had different projecting amounts H by which the front end of the insulator 10 projects and volumes Vc. Specifically, samples were prepared whose volumes were 5, 8, 11, 12 and 13 mm3, and projecting amounts H of their insulators 10 were adjusted from −0.5 mm to 3.0 mm in 0.5 mm increments, whereby a total of 40 different types of samples was prepared.

In this example, front ends of the insulators 10 of these samples were heated by a burner, and time was measured which was spent until the temperature of the front ends of the insulator 10 had reached 500° C. since the start of the heating. The temperature of 500° C. is a temperature at which carbon sticking to the vicinity of the front ends of the insulators 10 start to be burned off.

Figure 5:
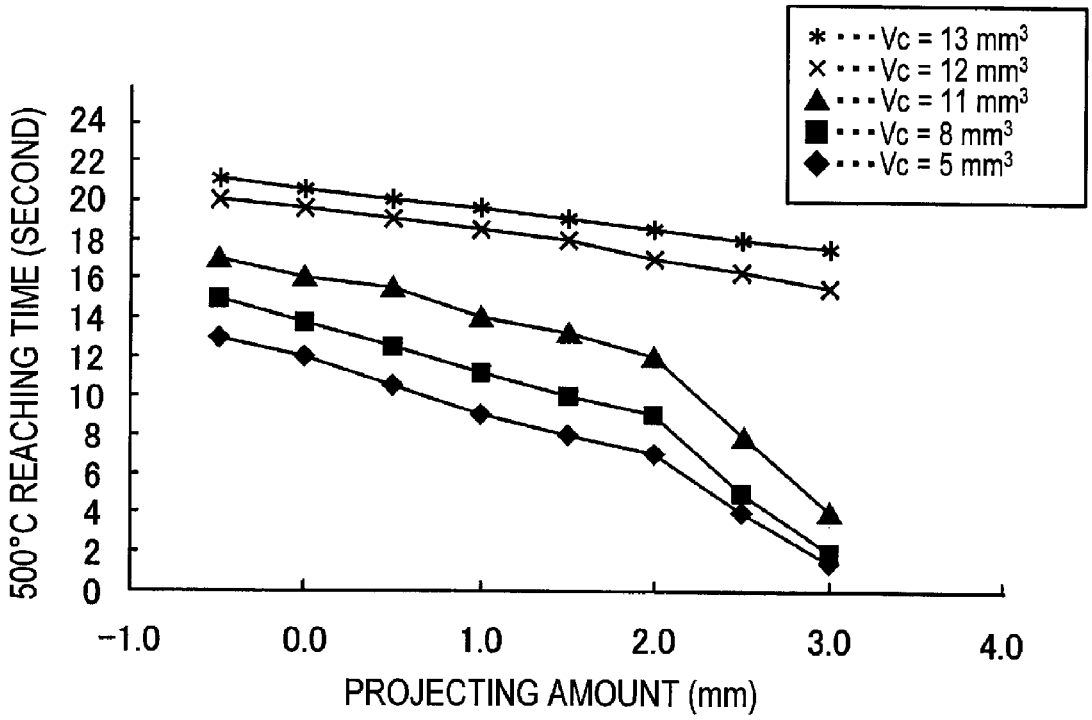
FIG. 5 is a graph showing results of an evaluation test in a first example.

FIG. 5 is a graph showing results of an evaluation test. As shown in the figure, according to this example, it could be verified that times spent by the samples whose projecting amounts H were 2 mm or larger in reaching 500° C. were intentionally shorter than those of the other samples. Because of this, the projecting amount H of the spark plug 100 of the embodiment is referred to as 2 mm or larger. With the projecting amount H referred to as that amount, even in the event that carbon sticks to the insulator 10, the carbon so sticking can be burned off quickly, thereby making it possible to suppress the occurrence of lateral spark, which tends to occur when carbon is deposited.

The reason that the position for defining the volume Vc is specified to the position lying 1 mm rearwards from the front end of the insulator 10 is that it could be verified that the temperature of the portion ranging from the front end to the position lying 1 mm rearwards therefrom was extremely higher than that of a portion lying further rearwards towards the rear end side.

C-2 Second Example

In a second example, the reason that the volume of the front end portion of the insulator 10 is referred to as 11 $mm^3$ or smaller and the reason that the clearance C and the spark gap G are specified so as to satisfy the relation (1) will be described. In this second example, firstly, samples of spark plugs 100 were prepared in which diameters D1 (refer to FIG. 2) of holes in front ends of metal shells 50, outside diameters D2 (refer to FIG. 2) of front ends of insulators 10, clearances C (refer to FIG. 2) and spark gaps G (refer to FIG. 2) were varied variously.

FIG. 6 is a table showing part of dimensions of the samples prepared in this example. As is shown in the table, in the samples prepared in this example, although the hole diameters D1 of the metal shells 50 were all 6 mm, the outside diameters D2 of the insulators 10 were caused to vary from 3.3 mm to 5.2 mm, the clearances C from 0.4 mm to 1.35 mm, and the gaps from 0.6 mm to 1.1 mm. Ratios of clearances C to spark gaps G (hereinafter, referred to as a "clearance ratio") of the individual samples are shown on a most right-hand column of the table. The clearance C is a value resulting from subtracting the outside diameter D2 of the insulator 10 from the hole diameter D1 of the metal shell and dividing the resulting value by 2. As to volume Vc, a plurality of volumes were prepared which ranged from 5 $mm^3$ to 13 $mm^3$ by changing the diameters of the center electrodes 20 of the samples.

Figure 7:
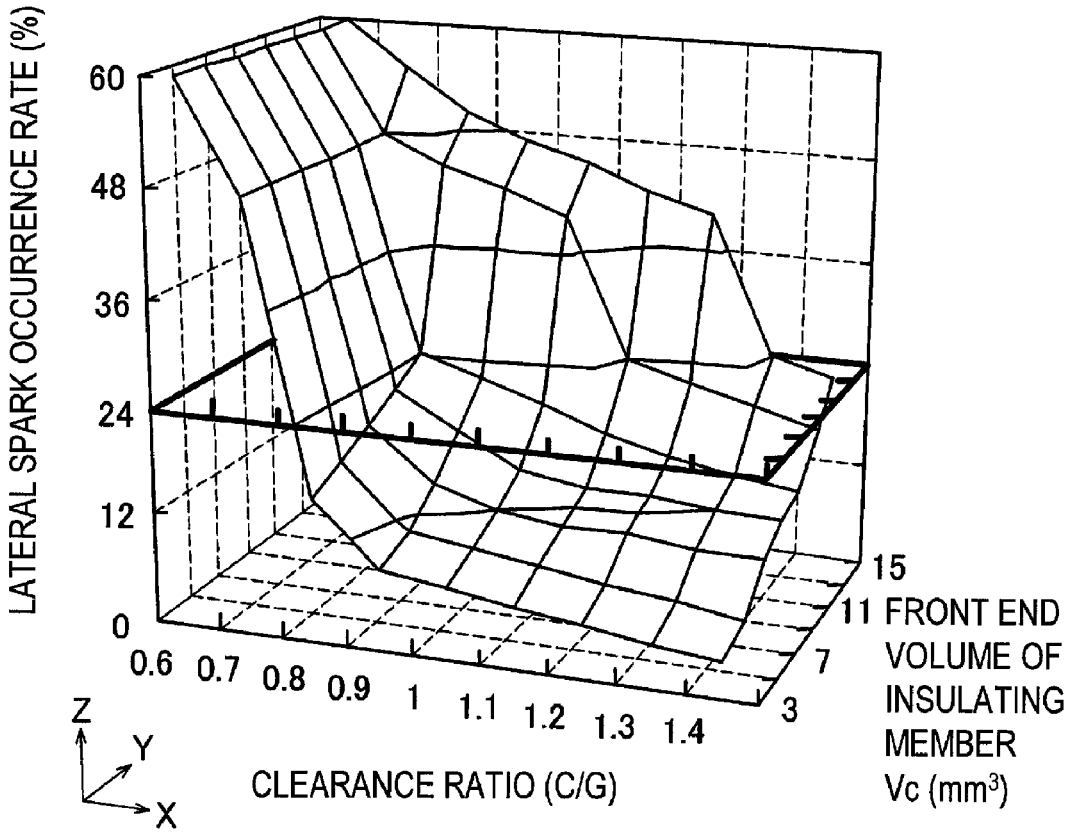
FIG. 7 is a graph showing an occurrence rate of lateral spark that occurred when a smoldering fouling test was carried out.

FIG. 7 is a graph showing occurrence rates of lateral spark which occurred when a smoldering fouling test was carried out. The smoldering fouling test is a test specified under "D 1606" of JIS (Japanese Industrial Standards). Specifically, the smoldering fouling test is a test for studying the degree at which spark plugs are fouled through smoldering when a motor vehicle is driven to a predetermined driving pattern which is close to an actual driving condition by placing a motor vehicle on a chassis dynamometer in a low temperature test room and installing spark plugs in an engine of the vehicle.

In the graph shown in FIG. 7, an X axis indicates clearance ratio (C/G), a Y axis volume Vc ($mm^3$) of the front end portion of the insulator, and a Z axis occurrence rates of lateral spark (%). In this graph, a thick solid line is given to a position where the occurrence rate of lateral spark is 24%. This thick solid line indicates an occurrence rate of lateral spark for a general spark plug of M14. Namely, it means that spark plugs having occurrence rates of lateral spark which lie at or below the thick solid line have ignition performances equal to or better than that of the spark plug of M14.

As is shown in FIG. 7, with samples whose clearance ratios were generally 0.8 or larger and volumes Vc were 11 $mm^3$ or smaller, the occurrence rate of lateral spark became 24% or smaller. It has been able to be verified when reference is made to FIG. 5 showing the results of the evaluation test in the first example that when the volume Vc exceeded 11 $mm^3$, it became difficult to burn off carbon quickly. Further, when the Vc exceeds 11 $mm^3$ or the clearance ratio exceeds 1.3, the clearance C (refer to FIG. 2) has to be secured largely. Then, the thicknesses of the metal shell 50 and the ground electrode 30 need to be reduced, which causes the occurrence of bending or melting of the ground electrode 30. From the observation of these facts, in the embodiment, the clearance ratio is specified to 0.8 or larger, and the volume Vc to 11 $mm^3$ or smaller. With the spark plug 100 configured in this way, the spark plug with a smaller diameter can be provided which has the ignition performance and strength which are equal to or better than those of the spark plug of M14.

C-3 Third Example

In a third example, the reason that the thickness T of the insulator 10 is specified to 0.7 mm or larger will be described. According to various experiments carried out by the applicant, it has been able to be verified that when the insulator was fouled with carbon, many lateral sparks occurred, whereas when the insulator was not so fouled, many inside sparks occurred. Then, in this third example, the following experiment was carried out to mainly suppress the occurrence of inside spark.

Namely, an experiment was carried out to study about a spark gap which triggers a inside spark by preparing samples in which thicknesses T of front end portions of insulators 10 were caused to vary in many ways, and adjusting dimensions of spark gaps of the samples so prepared. In this example, spark discharge was made 100 times for each spark gap, and when an inside spark occurred even once, it was judged that an inside spark was triggered with the spark gap. Namely, it means that with spark gaps larger than the spark gap, more inside sparks would occur.

Figure 8:
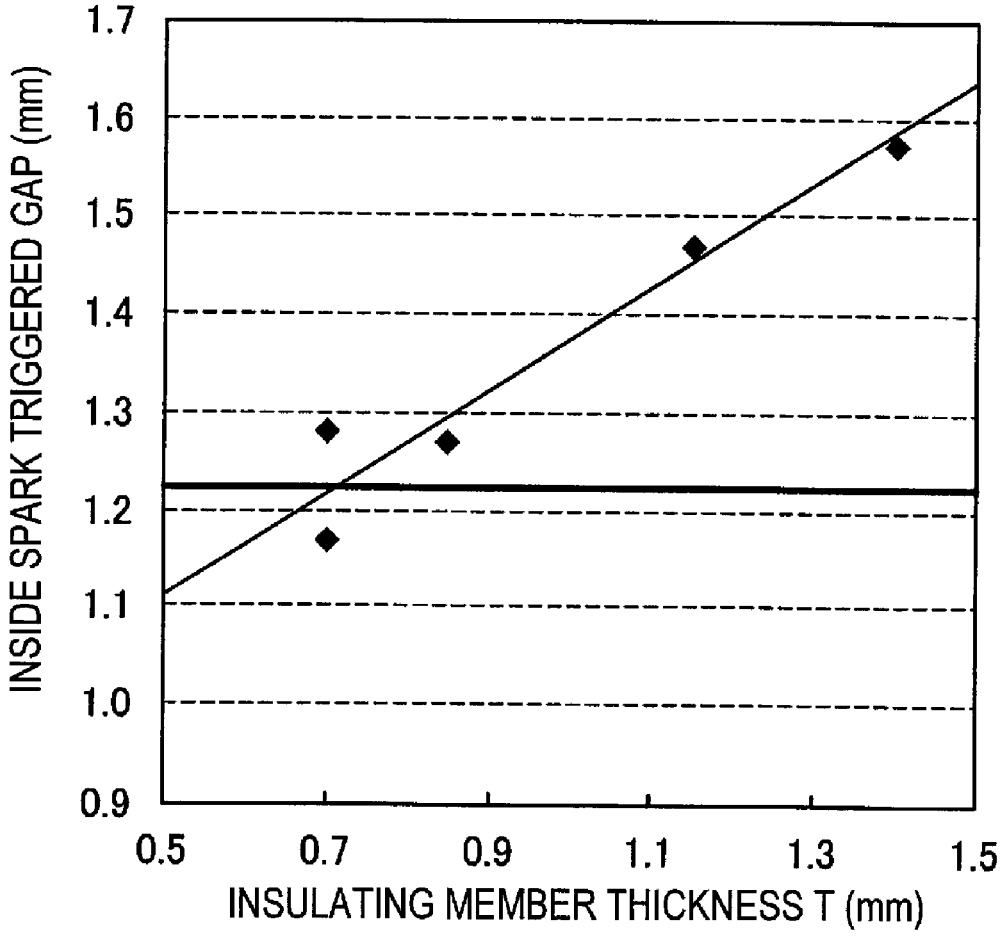
FIG. 8 is a graph showing results of an evaluation test in a third example.

FIG. 8 is a graph showing results of the evaluation test in this example. An axis of abscissa indicates thicknesses T of insulators 10, and an axis of ordinate indicates dimensions of spark gaps G where inside spark is triggered. In this graph, inside spark triggered gaps are plotted in association with thicknesses. A horizontal thick line shown in the graph indicates a dimension of a spark gap G of a general spark plug 100 of M14. In general, the ignitability is increased by such an extent that the spark gap is increased. Because of this, when a spark plug has an inside spark triggered gap which takes a value equal to or larger than the value expressed by the thick line in the figure, it means that the spark plug has an ignition performance equal to or better than that of the spark plug of M14.

Then, an approximate line was drawn based on individual evaluation values in the graph and a point was obtained where the approximate line intersected the thick line. As a result, the thickness T of the point of intersection was generally 0.7 mm. Namely, with the insulator 10 whose thickness T is referred to as 0.7 mm or larger, the spark plug can be provided which has the ignition performance equal to or better than that of the spark plug of M14 while suppressing inside spark.

C-4 Fourth Example

In a fourth example, the reason that the projecting amount E is specified to 0.75 mm or larger will be described. In the fourth example, samples were prepared in which projecting amounts were caused to vary in many ways, and a similar experiment to that in the third example was carried out.

Figure 9:
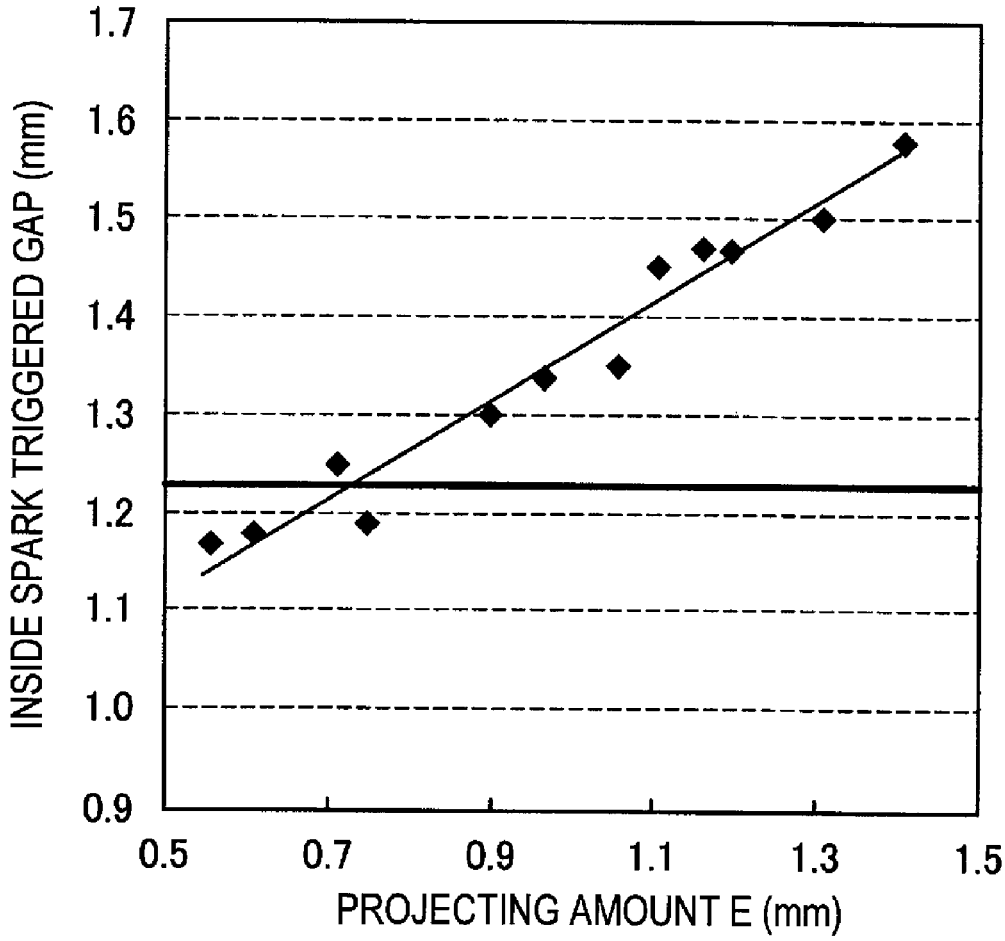
FIG. 9 is a graph showing results of an evaluation test in a fourth example.

FIG. 9 is a graph showing results of an evaluation test carried out in this example. An axis of abscissa denotes projecting mounts E of insulators 10, and an axis of ordinate denotes dimensions of spark gaps G which trigger inside spark. A horizontal thick line shown in the graph indicates a dimension of a spark gap G of a general spark plug of M14. As has been described above, the ignition performance is increased by such an extent that the spark gap G is increased. Because of this, when a spark plug has an inside spark triggered gap which takes a value equal to or larger than the value expressed by the thick line in the figure, it means that the spark plug has an ignition performance equal to or better than that of the spark plug of M14.

Then, an approximate line was drawn based on individual evaluation values in the graph and a point was obtained where the approximate line intersected the thick line. As a result, the projecting amount E of the point of intersection was generally 0.75 mm. Namely, with the insulator 10 whose projecting amount E is referred to as 0.75 mm or larger, since the distance of a path along which an inside spark is likely to occur (a path from the position PB to the position PC in FIG. 3) can be lengthened, the spark plug can be provided which has the ignition performance equal to or better than that of the spark plug of M14 while suppressing inside spark.

C-5 Fifth Example

In a fifth example, the reason that the diameter R1 of the center electrode 20 (hereinafter, referred to as a "center shaft diameter R1") and the diameter R2 of the small diameter portion 23 (hereinafter, referred to as a "pocket diameter R2") are specified so as to satisfy the relation (2) will be described. In this fifth example, spark plugs 100 whose center shaft diameter R1 was 1.9 mm and spark plugs 100 whose center shaft diameter R1 was 2.1 mm were prepared, and their pocket diameters R2 were varied to be 0.55 time, 0.65 time, 0.75 time, 0.85 time, and 1.0 time the center shaft diameters R1 thereof. Times spent in reaching a temperature of 500° C. were measured on the samples so prepared.

Figure 10:
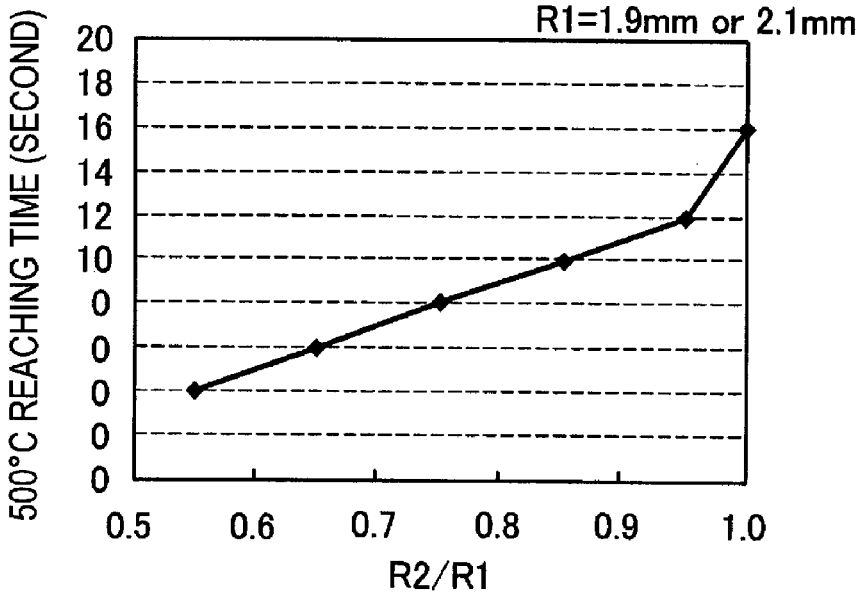
FIG. 10 is a graph showing results of an evaluation test in a fifth example.

FIG. 10 is a graph showing results of an evaluation test carried out in this example. An axis of abscissa represents rations R2/R1 of center shaft diameter R1 to pocket diameter R2. In this example, times spent reaching the temperature of 500° C. were measured on the spark plugs 100 whose center shaft diameter R1 was 1.9 mm and the spark plugs 100 whose center shaft diameter R1 was 2.1 mm. The times spent reaching the temperature of 500° C. showed almost similar values in the individual pocket diameters R2. Because of this, only one 500° C. reaching time is plotted for the individual rations R2/R1 in FIG. 10.

According to the experiment whose results are shown in FIG. 10, it was found that as the value of the ratio R2/R1 of center shaft diameter R1 to the pocket diameter R2 was reduced, that is, the gap of the pocket portion 26 was increased, the 500° C. reaching time was shortened. Namely, as the front end portion of the insulator 10 moves farther away from the center electrode 20, the temperature tends to be increased easily. Consequently, as the value of the ratio R2/R1 becomes lower, carbon can be burned off more quickly, whereby the occurrence of lateral spark can be suppressed effectively. Although a result of the evaluation test is shown in FIG. 10 in which the ratio R2/R1 was "1," that is, there existed no gap between the center electrode 20 and the insulator 10, this case resulted in the 500° C. reaching time becoming extremely longer than the sample in which even a slight gap exited between the center electrode 20 and the insulator 10. Namely, it means that providing a gap between the center electrode 20 and the insulator 10 is better than providing no gap therebetween. Then, in the embodiment, an upper limit value of the ratio R2/R1 of center shaft diameter R1 to pocket diameter R2 is specified to "0.95."

Incidentally, although as the temperature of the front end portion of the insulator 10 becomes higher, carbon can be burned off more quickly, preignition tends to occur easily. Then, to determine a lower limit value for the ratio R2/R1, in this example, an advance angle which triggers a preignition was studied by use of a known spark advance method. The spark advance method is a method for studying an angle which triggers a preignition by following steps (a) to (c).

(a) A certain spark advance angle is set, and a full load driving is started under a predetermined engine speed. Whether or not a preignition occurs is observed by an ion current detecting method during a continuous driving of two minutes.

(b) In case there is observed no preignition during the continuous driving of two minutes, the ignition timing is advanced repeatedly step by step in increments of an appropriate amount until a preignition is observed.

(c) In case a preignition occurs during a driving with a certain advance angle, the advance angle is recorded.

Figure 11:
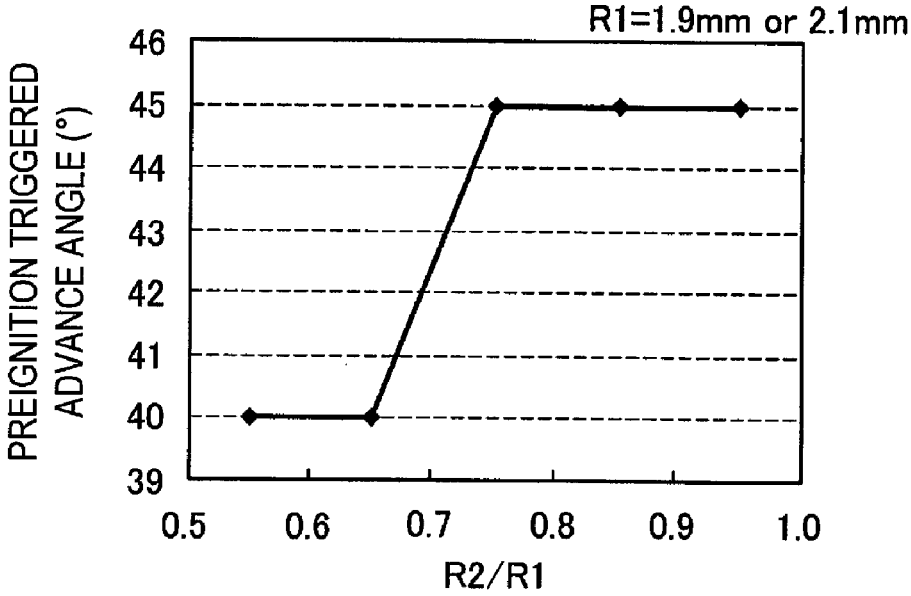
FIG. 11 is a graph showing results of the evaluation test in the fifth example.

FIG. 11 shows results of a measurement carried out by use of the spark advance method. In the figure, an axis of abscissa represents ratio R2/R1 of center shaft diameter R1 to pocket diameter R2, and an axis of ordinate represents advance angle which triggers a preignition. According to the results of the measurement shown in FIG. 11, it was found that a preignition occurred somewhere the ratio R2/R1 was 0.75. The delay in advance angle which triggers a preignition represents that the heat resistance of the spark plug 100 is low by such an extent, resulting in a lateral spark becoming easy to occur. Consequently, in the embodiment, the lower limit value for the ratio R2/R1 of center shaft diameter D1 to pocket diameter D2 is specified to "0.75" from the results of the measurement carried out.

C-6 Sixth Example

In a sixth example, the reason that the depth F of the pocket portion 26 is specified to 0.5 mm or larger and 2.0 mm or smaller. In this example, the depth F of the pocket portions 26 of spark plugs 100 whose ratio R2/R1 of center shaft diameter R1 to pocket diameter R2 was "0.75" was caused to vary in many ways, and an experiment was carried out to study about 500° C. reaching time and preignition triggered advance angle.

Figure 12:
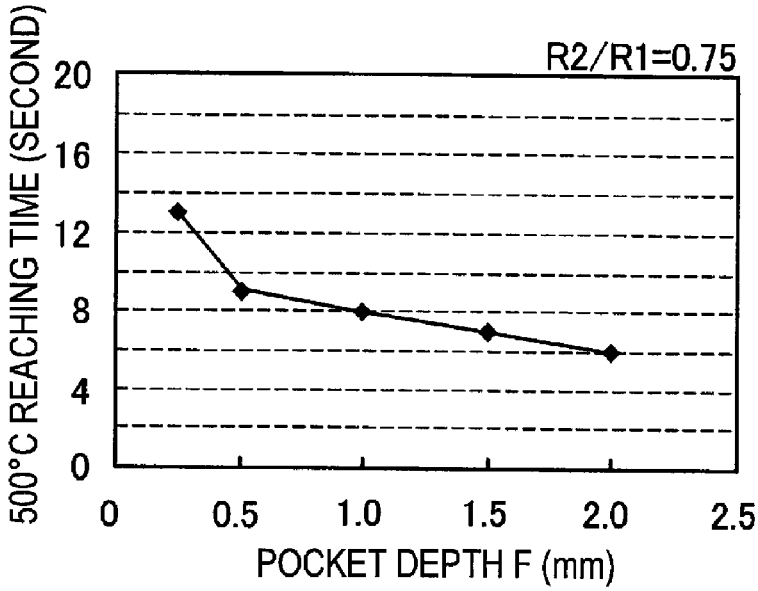
FIG. 12 is a graph showing results of an evaluation test a sixth example.

FIG. 12 is a graph showing 500° C. reaching times of the individual samples in which the depth F of the pocket portions 26 was changed from 0.25 mm to 2.0 mm. According to results of the experiment shown in this figure, it was found that with the depths of the pocket portions 26 being 0.5 mm or larger, the 500° C. reaching times were reduced intentionally to be shorter than those of the samples in which the depths of the pocket portions 26 were less than 0.5 mm. Because of this, in the embodiment, the lower value for the depth F of the pocket portion 26 is specified to 0.5 mm.

Figure 13:
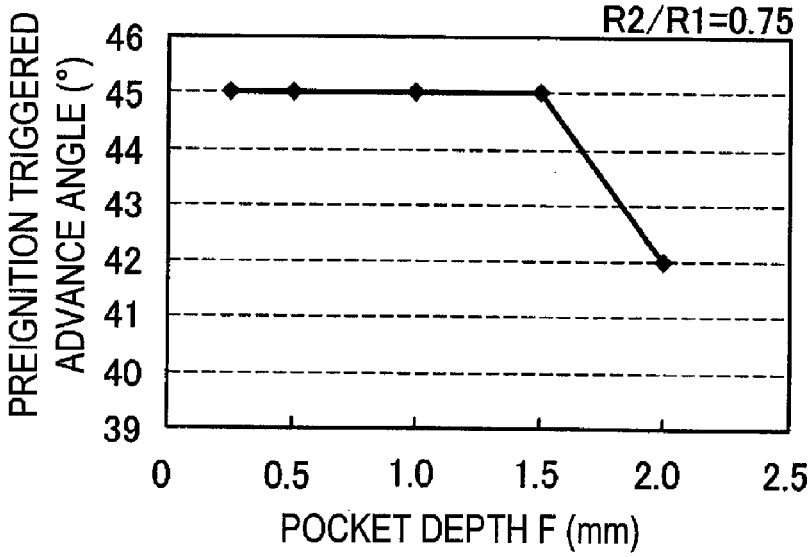
FIG. 13 is a graph showing results of the evaluation test in the sixth example.

FIG. 13 is a graph showing preignition triggered advance angles of the individual samples in which the depths F of the pocket portions 26 were changed from 0.25 mm to 2.0 mm. According to results of the experiment shown in this figure, it was found that with the depths F of the pocket portions 26 being not more than 2.0 mm, the advance angle at which the preignition was triggered was not delayed that much. Because of this, in the embodiment, the upper limit value for the depth F of the pocket portion 26 is specified to 2.0 mm.

D. MODIFIED EXAMPLES

While the embodiment and various examples of the invention have been described heretofore, the invention is not limited to the embodiment and examples that have been described above, and hence, needless to say, the invention can take various configurations without departing from the spirit and scope thereof. For example, the following modifications can be made.

D-1 Modified Example 1

In the embodiment, as is shown in FIG. 2, the electrode tip 90 is described as being provided at the front end of the center electrode 20. However, the mounting position of the electrode tip 90 is not limited thereto, and hence, the electrode tip 90 can be mounted in various positions.

Figure 14:
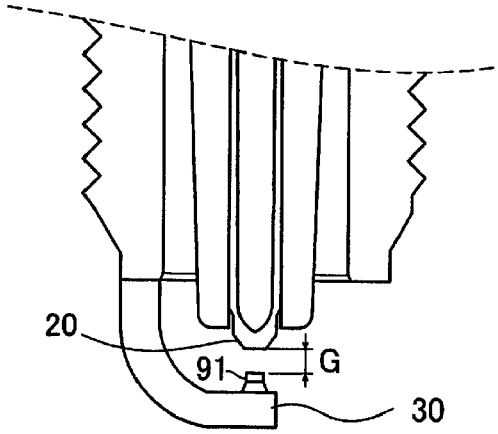
FIG. 14 is an explanatory view showing another form of a mounting position of an electrode tip.
Figure 15:
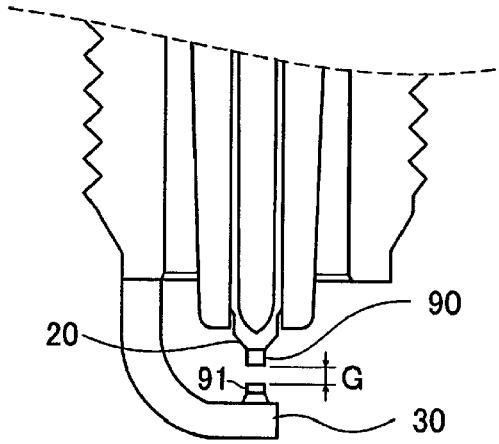
FIG. 15 is an explanatory view showing a further form of a mounting position of an electrode tip.
Figure 16:
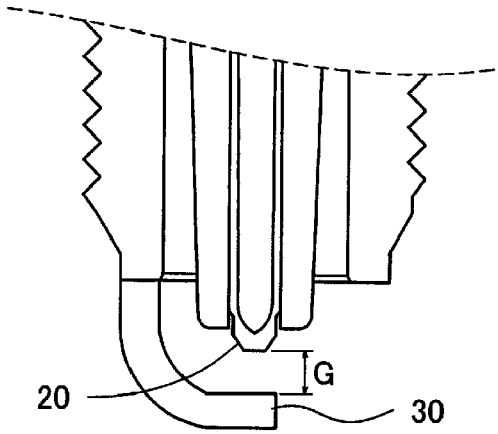
FIG. 16 is an explanatory view showing another form of a mounting position of an electrode tip.

FIGS. 14 to 16 are explanatory views showing other forms of electrode tip mounting positions. FIG. 14 shows an example in which an electrode tip 91 is provided at a distal end portion of a ground electrode 30. In this case, a spark gap G becomes a distance between the electrode tip 91 provided at a front end of the ground electrode 30 and a front end portion of a center electrode 20. FIG. 15 shows an example in which electrode tips 90, 91 are provided both on a front end portion of a center electrode 20 and a distal end portion of a ground electrode 30, respectively. In this case, a spark gap G becomes a distance between the electrode tip 90 and the electrode tip 91. As is shown in these examples, by the electrode tip/s being mounted on the front end portion of the center electrode 20 or/and the distal end portion of the ground electrode 30, the ignitability of the spark plug 100 can be improved. Of course, as is shown in FIG. 16, a form can also be acceptable in which an electrode tip is provided on neither a center electrode 20 nor a ground electrode 30. In this case, a spark gap G becomes a distance between a front end portion of the center electrode 20 and a distal end portion of the ground electrode 30. Namely, whether or not the electrode tip is provided, the spark gap G denotes a dimension of a portion where a spark discharge is normally generated.

D-2 Modified Example 2

Figure 17:
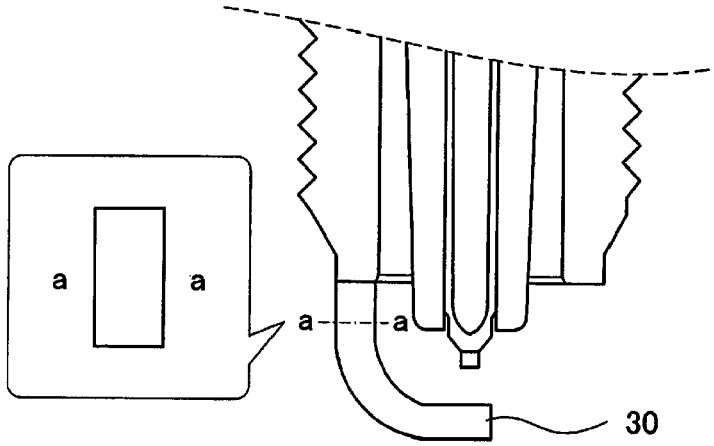
FIG. 17 is an explanatory view showing a cross-sectional shape of a ground electrode 30.

In the embodiment, as is shown in FIG. 17, the ground electrode 30 is described as having the substantially rectangular shape as the cross section (a section taken along the line a-a in the figure) which is taken along the plane at right angles to the longitudinal direction thereof. Dimensions of the cross section can be 1.1 mm wide and 2.2 mm long. However, the shape of the cross section of the ground electrode 30 is not limited thereto, and hence, the ground electrode 30 can have various cross-sectional shapes.

Figure 18:
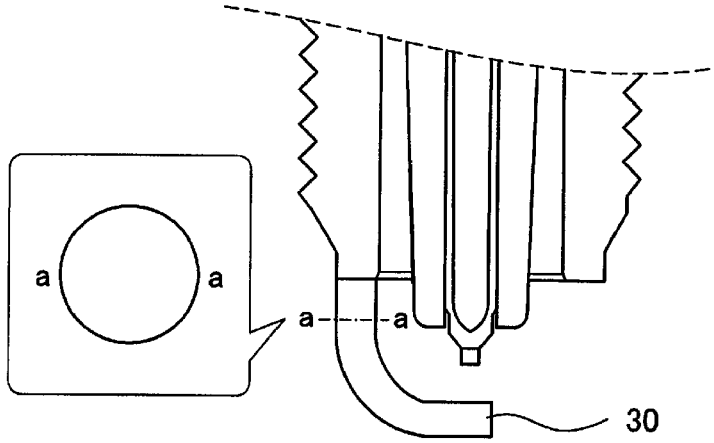
FIG. 18 is an explanatory view showing another cross-sectional shape of a ground electrode 30.
Figure 19:
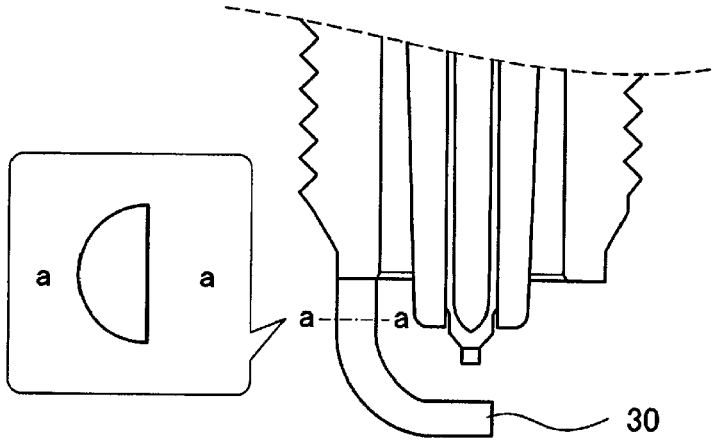
FIG. 19 is an explanatory view showing a further cross-sectional shape of a ground electrode 30.

FIGS. 18 and 19 are explanatory views showing other forms of cross-sectional shapes of ground electrodes 30. FIG. 18 shows an example in which a cross section of a ground electrode 30 is a substantially circle. FIG. 19 shows an example in which a cross section of a ground electrode 30 is a substantially semi-circle whose flat plane portion is oriented towards a center electrode 20. In these forms, the sectional areas of the ground electrodes 30 can be referred to as a cross-sectional area (=1.1 mm×2.2 mm) which is approximately the same as that of the rectangle shown in FIG. 17, for example. In addition, the sectional shape of the ground electrode 30 is not limited to the examples shown in FIGS. 18 and 19, and hence, in addition to those described heretofore, for example, an oval shape, a trapezoidal shape and other polygonal shapes can be adopted as the cross-sectional shape of the ground electrode 30.

D-3 Modified Example 3

In the embodiment, as is shown in FIG. 2, the distal end portion of the ground electrode 30 is described as facing the front end portion of the center electrode 20 on the axis O. However, the positional relationship between the distal end portion of the ground electrode 30 and the front end portion of the center electrode 20 is not limited thereto.

Figure 20:
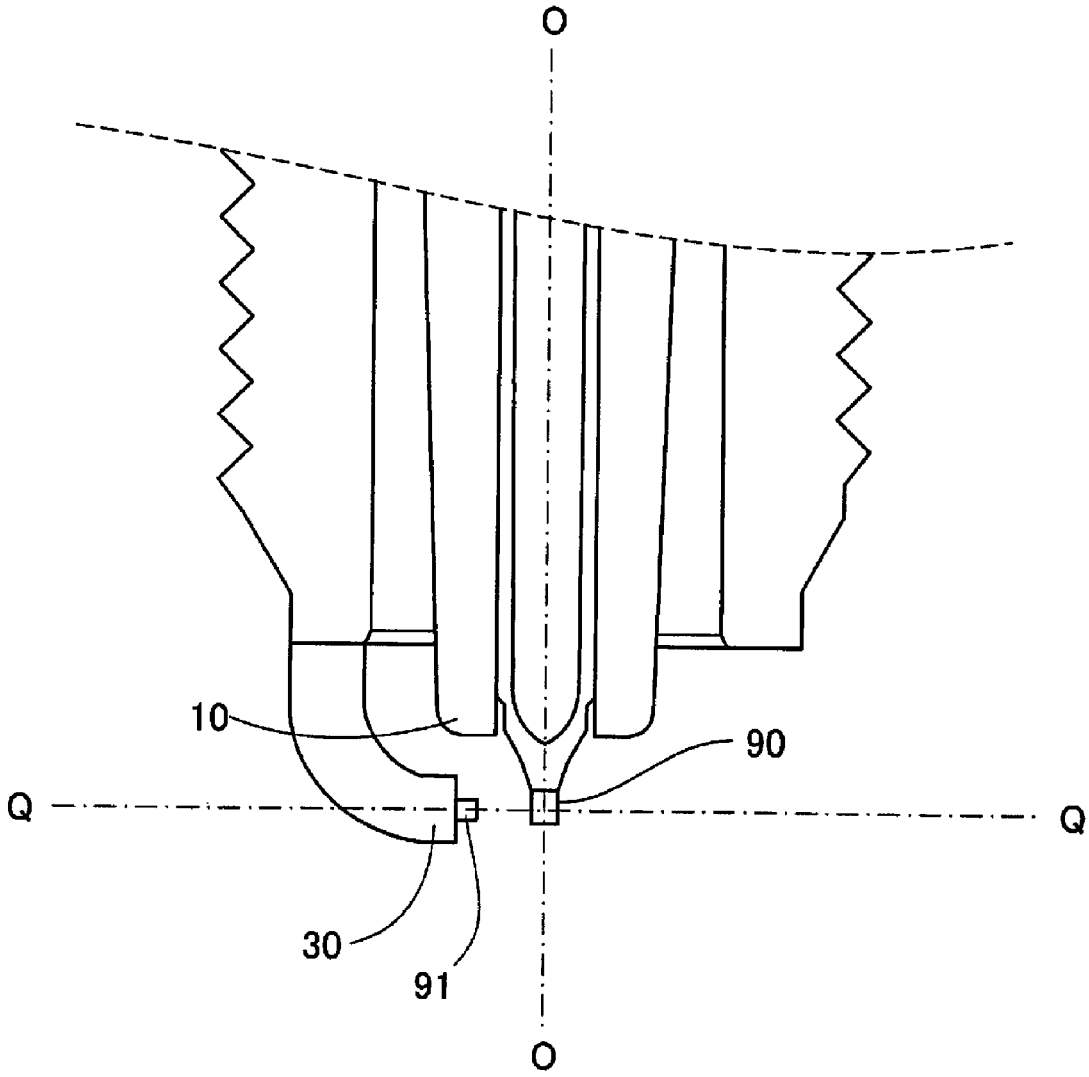
FIG. 20 is an explanatory view showing a modified example of a positional relationship between a distal end portion of a ground electrode 30 and the front end portion of the center electrode 20.
Figure 21:
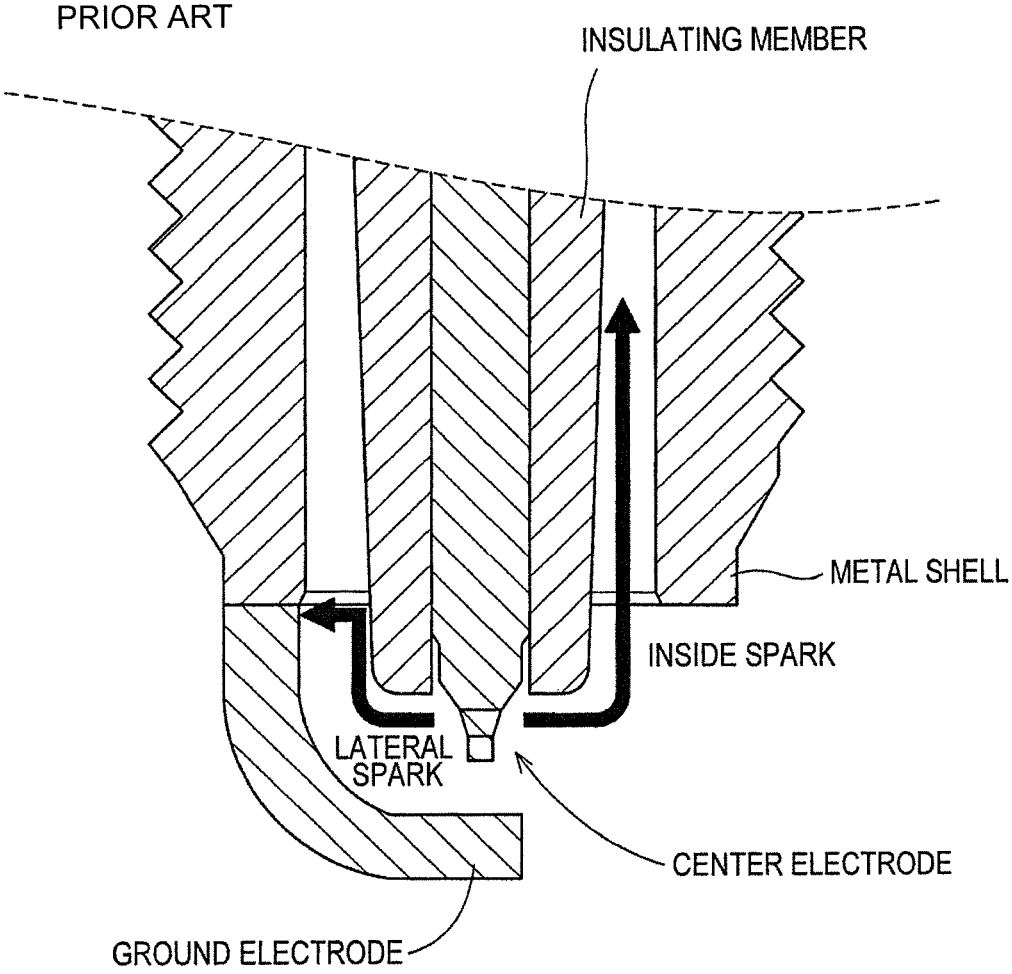
FIG. 21 PRIOR ART
FIG. 21 is an explanatory view showing concepts of a lateral spark and an inside spark.

FIG. 20 is an explanatory view showing another positional relationship between a distal end portion of a ground electrode 30 and a front end portion of a center electrode 20. As is shown in the figure, in this modified example, the distal end portion of the ground electrode 30 is made to face the front end portion of the center electrode 20 at the front end portion of the center electrode 20 on an axis Q which intersects an axis O. In this mode, a spark discharge is generated not on the axis O but on the axis Q. In addition to this positional relationship, a distal end portion of a ground electrode 30 may be made to face a front end portion of a center electrode 20 at a predetermined angle formed relative to an axis O. In either of the cases, a front end portion of an insulator 10 is made not to exist on the axis on which the front end portion of the center electrode 20 and the distal end portion of the ground electrode 30 face each other. The positional relationship between the distal end portion of the ground electrode 30 and the front end portion of the center electrode 20 can be set as required in accordance with applications of the spark plug or performances required.

The invention claimed is:

1. A spark plug comprising:

a rod-shaped center electrode;

a substantially cylindrical insulating member which has an axial hole extending along a direction of an axis of the center electrode and holds the center electrode within the axial hole while allowing a front end portion of the center electrode to be exposed;

a substantially cylindrical metal shell which is provided around an outer circumference of the insulating member; and a ground electrode which is joined to a front end face of the metal shell and which forms a spark gap with a front end portion of the center electrode, wherein a front end portion of the insulating member projects 2 mm or more from the front end face of the metal shell, and a volume of a portion of the insulating member which lies within a range from a front end to a position lying 1 mm towards a rear end of the insulating member from the front end is 11 $mm^3$ or smaller, and wherein when assuming in a section of the spark plug which passes through the axis that:

a corner portion where a front end face of the insulating member and a side surface of the axial hole intersect is referred to as a position PA, a position on the center electrode where a straight-line distance from the position PA to the center electrode within the axial hole becomes shortest is referred to as a position PB, a position where the insulating element first contacts the metal shell from the front end face of the insulating member along a surface of the insulating member is referred to as a position PC, and a position on the insulating member where when a straight line BC which connects the position PB with the position PC is displaced parallel towards an outside of the axis, the straight line BC contacts the surface of the insulating member is referred to as a position PD, a parallel displacement amount E by which the straight line BC is displaced parallel so as to contact the position PD is 0.75 mm or more.

2. The spark plug according to claim 1, wherein a thickness of the insulating member in a position lying 1 mm towards the rear end from the front end of the insulating member is 0.7 mm or larger.

3. The spark plug according to any claim 1, wherein an outside diameter of the center electrode is 1.2 mm or larger and 2.1 mm or smaller in a position corresponding to the front end face of the metal shell.

4. The spark plug according to claim 1, wherein a noble metal tip is provided on at least either of the front end portion of the center electrode and a distal end portion of the ground electrode.

5. The spark plug according to any claim 1, wherein the front end portion of the center electrode and the distal end portion of the ground electrode face each other on the axis of the center electrode.

6. The spark plug according to claim 1, wherein the front end portion of the center electrode and the distal end portion of the ground electrode face each other outside the axis of the center electrode.

7. The spark plug according to any claim 1, wherein the metal shell comprises a mounting portion having threads provided for tightening the spark plug to an internal combustion engine in part of the metal shell, and wherein a thread portion of the mounting portion being M10 or M12.

8. A spark plug comprising:

a rod-shaped center electrode;

a substantially cylindrical insulating member which has an axial hole extending along a direction of an axis of the center electrode and holds the center electrode within the axial hole while allowing a front end portion of the center electrode to be exposed;

a substantially cylindrical metal shell which is provided around an outer circumference of the insulating member; and a ground electrode which is joined to a front end face of the metal shell and which forms a spark gap with a front end portion of the center electrode, wherein a front end portion of the insulating member projects 2 mm or more from the front end face of the metal shell, and a volume of a portion of the insulating member which lies within a range from a front end to a position lying 1 mm towards a rear end of the insulating member from the front end is 11 $mm^3$ or smaller, and wherein when assuming in a section of the spark plug which passes through the axis that:

a corner portion where a front end face of the insulating member and a side surface of the axial hole intersect is referred to as a position PA, a position on the center electrode where a straight-line distance from the position PA to the center electrode within the axial hole becomes shortest is referred to as a position PB, a position where the insulating element first contacts the metal shell from the front end face of the insulating member along a surface of the insulating member is referred to as a position PC, and a position on the insulating member where when a straight line BC which connects the position PB with the position PC is displaced parallel towards an outside of the axis, the straight line BC contacts the surface of the insulating member is referred to as a position PD, a parallel displacement amount E by which the straight line BC is displaced parallel so as to contact the position PD is 0.75 mm or more, wherein a small diameter portion where a diameter of the front end portion of the center electrode is reduced is formed at the front end portion of the center electrode, and the diameter R1 of the front end portion of the center electrode and the diameter R2 of the small diameter portion have the following relationship, $$0.75 \leqq R2/R1 \leqq 0.95.$$

9. The spark plug according to claim 8, wherein a depth of a gap defined between the small diameter portion and the insulating member from the front end face of the insulating member is 0.5 mm or larger and 2.0 mm or smaller.

10. A spark plug comprising:

a rod-shaped center electrode;

a substantially cylindrical insulating member which has an axial hole extending along a direction of an axis of the center electrode and holds the center electrode within the axial hole while allowing a front end portion of the center electrode to be exposed;

a substantially cylindrical metal shell which is provided around an outer circumference of the insulating member; and a ground electrode which is joined to a front end face of the metal shell and which forms a spark gap with a front end portion of the center electrode, wherein a front end portion of the insulating member projects 2 mm or more from the front end face of the metal shell, and a volume of a portion of the insulating member which lies within a range from a front end to a position lying 1 mm towards a rear end of the insulating member from the front end is 11 $mm^3$ or smaller, and wherein when assuming in a section of the spark plug which passes through the axis that:

a corner portion where a front end face of the insulating member and a side surface of the axial hole intersect is referred to as a position PA, a position on the center electrode where a straight-line distance from the position PA to the center electrode within the axial hole becomes shortest is referred to as a position PB, a position where the insulating element first contacts the metal shell from the front end face of the insulating member along a surface of the insulating member is referred to as a position PC, and a position on the insulating member where when a straight line BC which connects the position PB with the position PC is displaced parallel towards an outside of the axis, the straight line BC contacts the surface of the insulating member is referred to as a position PD, a parallel displacement amount E by which the straight line BC is displaced parallel so as to contact the position PD is 0.75 mm or more, wherein the front end portion of the insulating member and the front end portion of the metal shell are disposed to provide a predetermined gap in a position corresponding to the front end face of the metal shell, and wherein a dimension of the gap is 0.8 to 1.3 times a dimension of a spark gap defined between the ground electrode and the center electrode.

11. The spark plug as set forth in claim 10, wherein the dimension of the spark gap is 0.6 mm or larger and 1.2 mm or smaller.

* * * * *